US007703627B2

(12) United States Patent
Yuhara et al.

(10) Patent No.: US 7,703,627 B2
(45) Date of Patent: Apr. 27, 2010

(54) VANITY CASE

(75) Inventors: Yukitomo Yuhara, Chiba (JP); Yuzo Yoshida, Tokyo (JP)

(73) Assignee: Yoshida Industry Co., Ltd., Tokyo (JP)

( * ) Notice: Subject to any disclaimer, the term of this patent is extended or adjusted under 35 U.S.C. 154(b) by 449 days.

(21) Appl. No.: 11/539,207

(22) Filed: Oct. 6, 2006

(65) Prior Publication Data

US 2007/0090106 A1 Apr. 26, 2007

(30) Foreign Application Priority Data

Oct. 26, 2005 (JP) ..... 2005-311965

(51) Int. Cl.
*B65D 45/16* (2006.01)

(52) U.S. Cl. ..... 220/326; 220/4.22; 220/23.4; 220/835; 362/136

(58) Field of Classification Search ..... 132/294, 132/301; 206/581; 220/4.22, 23.4, 326, 220/835; 362/136
See application file for complete search history.

(56) References Cited

U.S. PATENT DOCUMENTS

RE20,986 E * 1/1939 Kreisler ..... 220/326
3,006,510 A * 10/1961 Sagarin ..... 222/402.13
4,483,355 A * 11/1984 Yuhara ..... 132/301
5,320,116 A 6/1994 Ackermann et al.

FOREIGN PATENT DOCUMENTS

| | | |
|---|---|---|
| FR | 2534787 | 4/1984 |
| FR | 2610802 | 8/1988 |
| GB | 2205348 | 12/1988 |
| JP | S62-13530 | 5/1984 |

* cited by examiner

*Primary Examiner*—Anthony Stashick
*Assistant Examiner*—Elizabeth Volz
(74) *Attorney, Agent, or Firm*—Harness, Dickey & Pierce, PLC

(57) ABSTRACT

A vanity case which comprises a case body having a cavity, a lid coupled to the back section of the case body, an inner plate received in the cavity, and a slide piece housed in between the case body and the inner plate. The lid has an engaging claw piece formed hanging down on the front of its underside; the slide piece has an engaging arm protruding above and is always biased backwards. When the lid is closed, the engaging claw piece engages the engaging arm. A rear end wall in the rear of the case body is formed to be elastically deformable toward the front, and when the rear end wall is pushed toward the front, the slide piece whose rear end is opposite the rear end wall is moved forwards, thereby releasing the engagement between the engaging arm and the engaging claw piece and opening the lid.

13 Claims, 4 Drawing Sheets

VANITY CASE

CROSS-REFERENCE TO RELATED APPLICATIONS

The present application claims priority from Japanese Patent Application No. 2005-311965 filed on Oct. 26, 2005, which is herein incorporated by reference.

BACKGROUND OF THE INVENTION

1. Field of the Invention

The present invention relates to a vanity case for containing a cosmetic material that can improve appearance when its lid is closed against its case body and that can secure good operability with preventing the intrusion of dust into the case body.

2. Description of the Related Art

To date, a vanity case of which the lid is opened by operation at the rear of its case body has been known (refer to Japanese Examined Utility Model Application Publication No. S62-13530). This vanity case has a recess formed in the back of its case body, and the hinge blocks of a lid are received in and coupled to the recess thus allowing the lid to be openable/closable against the case body. Further, a guide groove is formed in the inside bottom surface of the case body, and a slide piece is disposed in the guide groove, which is slidable backwards and forwards in the case body and biased so as to be returnable to a predetermined back position. The slide piece has an upright portion, on the inward face of which a tab is formed opposite an engaging member protruding from the underside of the lid so as to detachably engage with it. The rear end of the slide piece protrudes into the recess of the case body without contacting the hinge blocks of the lid. An elastic member for biasing the lid toward opening is interposed in between the underside of the periphery of the lid and the top of the periphery of the case body. By pushing the rear end of the slide piece forwards, the engagement between the tab of the slide piece and the engaging member of the lid is released, thus opening the lid.

In the above vanity case, the rear end of the slide piece, which is pushed forwards when the lid is opened, protrudes into the recess of the case body, exposing itself to the outside. Hence, when the rear end of the slide piece is pushed forwards, the back face of the case body is partly recessed between the hinge blocks of the lid. Accordingly, there is the problem that the appearance is not good for a vanity case.

Further, because the recess is directly open to behind the case body, dust or the like is likely to intrude into the case body.

Yet further, because the width of the rear end of the slide piece is limited by the width of the recess, if the width of the recess is reduced to prevent the intrusion of dust or the like, the width of the rear end of the slide piece to be touched by a finger for push operation is also reduced, and thus, smooth operability cannot be secured. Conversely, if the width of the recess and thus the width of the rear end of the slide piece are increased, dust or the like is more likely to intrude into the case body.

SUMMARY OF THE INVENTION

The present invention was made in view of the above problems of the prior art, and an object thereof is to provide a vanity case that can improve its appearance and that can secure good operability with preventing the intrusion of dust into the case body.

According to the present invention, there is provided a vanity case which comprises a case body having a cavity, a lid that is coupled to the back section of the case body in an openable/closable manner, an inner plate that is received in an exchangeable manner in the cavity of the case body, and a slide piece that is housed in between the case body and the inner plate so as to be movable forwards and backwards. The lid has an engaging claw piece formed hanging down on the front of its underside. The slide piece has an engaging arm protruding above that can engage with the engaging claw piece and is always biased elastically backwards. The lid is always biased elastically toward opening of the case body. When the lid is closed against the case body, the engaging claw piece of the lid engages with the engaging arm of the slide piece and thus the lid is in a closed position. When the slide piece is moved forwards, the engagement between the engaging arm of the slide piece and the engaging claw piece of the lid is released, thus opening the lid. The vanity case is characterized in that a rear end wall in the center of the rear of the case body is formed to be elastically deformable toward the front, and the rear end of the slide piece is placed opposite the inside surface of the rear end wall, and in that when the rear end wall is pushed toward the front, the slide piece is moved forwards, thereby releasing the engagement between the engaging arm of the slide piece and the engaging claw piece of the lid.

Furthermore, a pair of recesses are formed on the left and right of the rear end wall of the case body. Left and right hinge protrusions protrude downwards from the rear end of the lid. The hinge protrusions are received in the pair of recesses so as to be hinge-coupled to the case body. In the state where the lid is closed against the case body, the rear faces of the hinge protrusions and the rear end wall of the case body are substantially on the same vertical plane.

Yet further, the cavity of the case body is surrounded by a front wall, side walls, and a back wall divided at its center into two separate parts, and the rear end wall is formed separately from and behind the back wall with arms between the walls.

Still further, an elastic member may be provided in between the case body and the lid to always bias the lid toward opening.

Moreover, a mark indicating an operation position may be provided on the rear end wall.

Features and objects of the present invention other than the above will become apparent from the description of this specification and the accompanying drawings.

BRIEF DESCRIPTION OF THE DRAWINGS

For a more complete understanding of the present invention and the advantages thereof, reference is now made to the following description taken in conjunction with the accompanying drawings wherein.

DETAILED DESCRIPTION OF THE INVENTION

Figure 1:
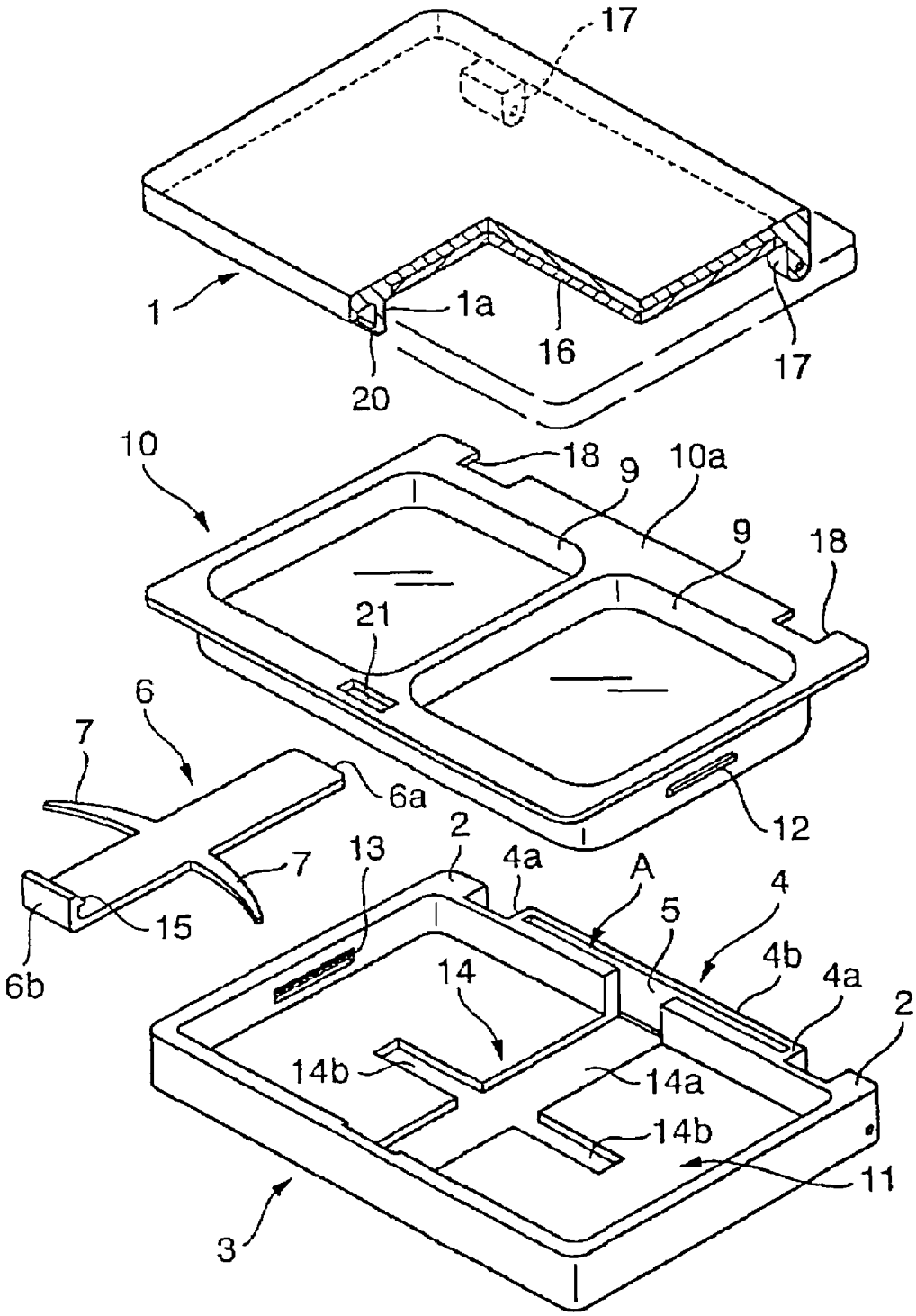
FIG. 1 is an exploded perspective view of a preferred embodiment of a vanity case according to the present invention.
Figure 2:
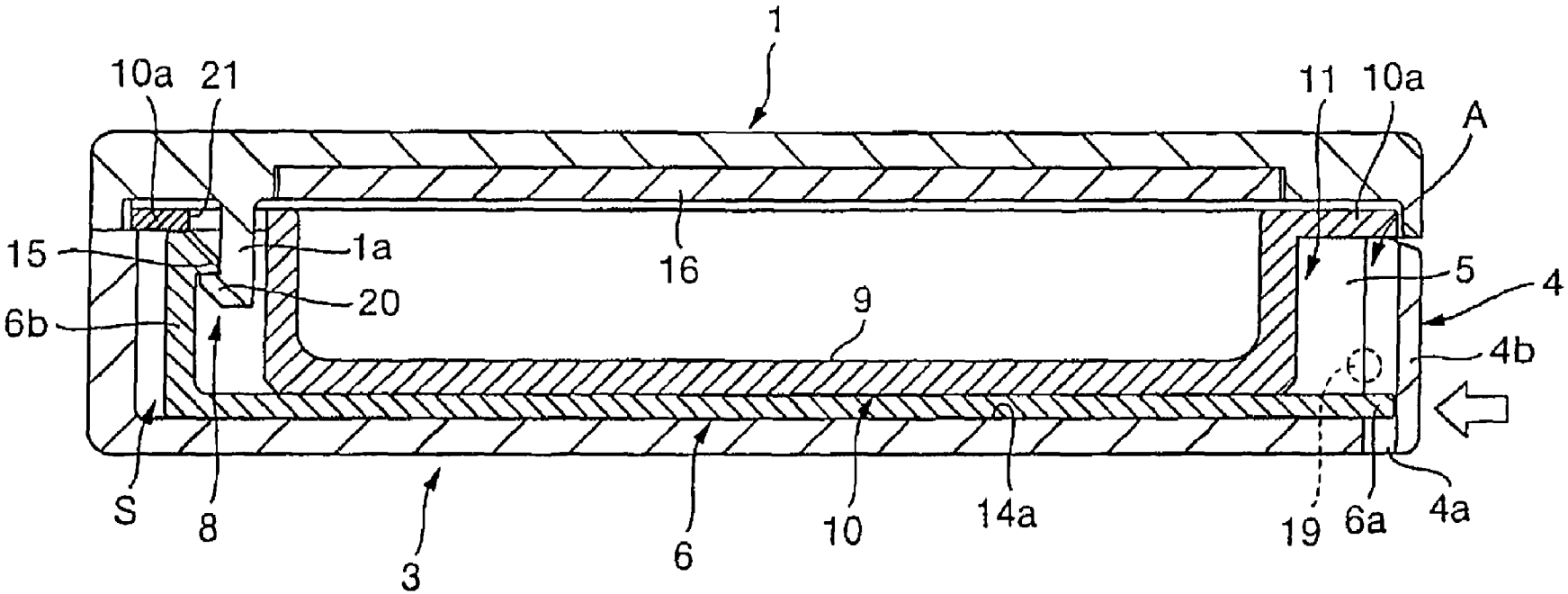
FIG. 2 is a side sectional view of the vanity case of FIG. 1.
Figure 3:
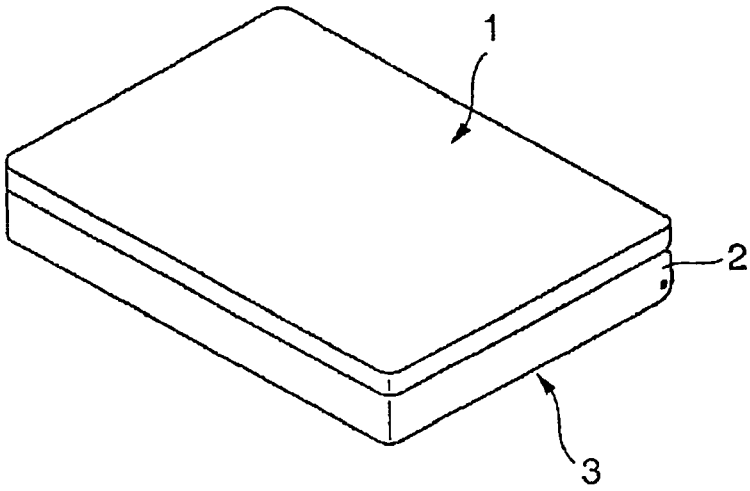
FIG. 3 is a perspective view of the vanity case of FIG. 1 as seen from above front.
Figure 4:
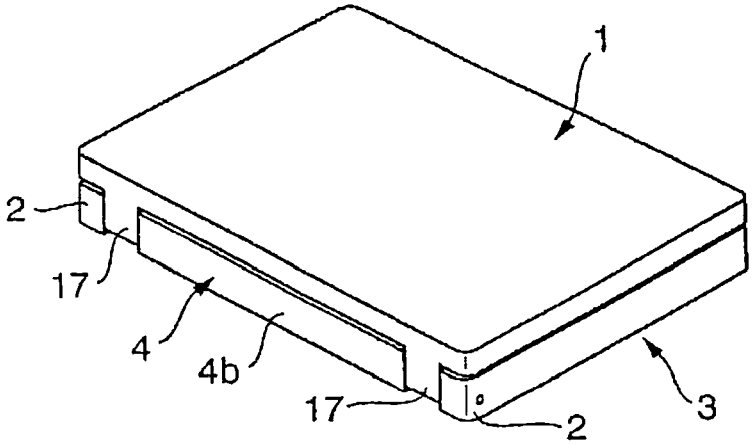
FIG. 4 is a perspective view of the vanity case of FIG. 1 as seen from above behind.
Figure 5:
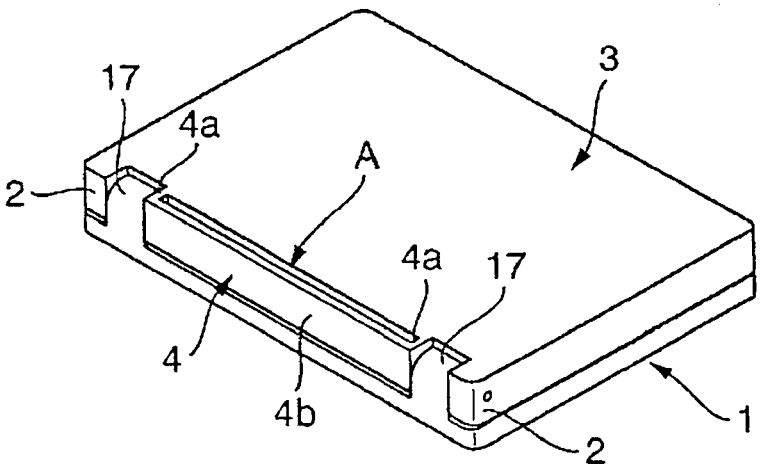
FIG. 5 is a perspective view of the vanity case of FIG. 1 as seen from below behind.

At least the following matters will be made clear by the explanation in the present specification and the description of the accompanying drawings.

A preferred embodiment of a vanity case according to the present invention will be described below in detail with reference to the accompanying drawings. As shown in FIGS. 1 to 6, the vanity case according to the present embodiment essentially comprises a case body 3 having a cavity 11, a lid 1 that is coupled to the back section of the case body 3 in an openable/closable manner, an inner plate 10 that is received in an exchangeable manner in the cavity 11 of the case body 3, and a slide piece 6 that is housed in between the case body 3 and the inner plate 10 so as to be movable forwards and backwards.

The cavity 11 of the case body 3, which receives the inner plate 10 having two cosmetic containing sections 9, is surrounded by a front wall, side walls, and a back wall divided at its center into two separate parts to form an opening 5. The side walls of the case body 3 have engaging recesses 13 formed at their inside, which engage with engaging tabs 12 formed on the side wall outer surfaces of the inner plate 10 so that the inner plate 10 is held in the cavity 11. A pair of left and right hinge portions 2 is formed integrally in the case body 3 back section so as to protrude backwards from both its corners. A rear end wall 4 of a long length is formed integrally in the middle of the rear of the case body 3 and in between the hinge portions 2 so as to be separate from and behind the back wall with its arms 4*a* between the walls. The rear end wall 4 is made up of the arms 4*a* and an elastic strip 4*b* formed between the arms 4*a* that is separated a space "A" away from the back wall and that, when pushed toward the front of the case body 3, is elastically deformed so as to bend into the space "A" approaching the back wall. The arms 4*a* each have a length corresponding to the length of the protruding portion of the hinge portion 2.

The inner plate 10 has a canopy 10*a* formed integrally therewith that protrudes outwards from its upper periphery, and the rear end wall 4 is covered by the canopy 10*a* from above. Further, in the case body 3 back section, the opening 5 is formed that faces the rear end wall 4 making the cavity 11 open to the rear. Thus, this opening 5 is located at such a position as to be concealed by the rear end wall 4 as seen from behind the case body 3.

Formed in the bottom surface of the cavity 11 of the case body 3 is a substantially cross-shaped groove 14 made up of a longitudinal groove 14*a* extending in the front-to-back direction of the case body 3 and a transverse groove 14*b* extending in the left-to-right direction. The longitudinal groove 14*a* is formed across the cavity 11 from the front end to the rear end, and its rear end is in communication with the opening 5. The plate-like slide piece 6 is provided in this groove 14. The slide piece 6 whose length along the longitudinal groove 14*a* is shorter than that of the longitudinal groove 14*a* is provided so as to be slidable backwards and forwards in the longitudinal groove 14*a*. The slide piece 6 has formed integrally therewith a pair of elastic arms 7 which extend respectively left and right in the transverse groove 14*b* from the slide piece 6, as spring members that are resilient against the case body 3 in the transverse groove 14*b* thereby biasing the slide piece 6 backwards in the case body 3.

The rear end of the slide piece 6 forms a push portion 6*a*, which protrudes toward the elastic strip 4*b* of the rear end wall 4 through the opening 5 when the slide piece 6 is put in a back position in the case body 3 by the elastic arms 7. Hence, by pushing the rear end wall 4 toward the front of the case body 3, the push portion 6*a* is pushed and thus moved toward the front of the case body 3. When not being pushed, the slide piece 6 is put in the back position in the case body 3 by the elastic arms 7, and the push portion 6*a* protrudes to the rear through the opening 5.

An upright wall 6*b* is formed integrally on the front end of the slide piece 6, and a hook piece 15 protruding backwards is formed on the upper end of the upright wall 6*b*. The hook piece 15 is moved backwards and forwards as the slide piece 6 slides backwards and forwards with use of a space "S" formed between the inner plate 10 and the case body 3 under the canopy 10*a*.

The lid 1 with a mirror 16 that opens and closes the case body 3 is coupled thereto. On the back section of the lid 1, a pair of left and right hinge protrusions 17 is formed integrally so as to hang down into a pair of recesses formed between the pair of left and right hinges 2 and the rear end wall 4 in the case body 3 back section. Squared notches 18 are formed in the canopy 10*a* of the inner plate 10 so as to avoid interference with the hinge protrusions 17. A hinge pin 19 that couples rotatably the hinge protrusions 17 to the hinges 2 and thus the lid 1 to the case body 3 is inserted through the left and right hinge protrusions 17 and hinges 2. The hinge protrusion 17 is formed in an outer shape matching that of the hinge 2 protruding from the rear of the case body 3. Furthermore, the rear end wall 4 is formed to have a length corresponding to the distance between the pair of hinge protrusions 17 that are coupled to the left and right hinges 2. Hence, the rear of the case body 3 is in a cohesive form with the hinges 2, the hinge protrusions 17, and the rear end wall 4, which protrude from the case body 3 back section by substantially the same protruding amounts, thus their rear faces being substantially on the same vertical plane, and are disposed laterally adjacent to each other substantially without spaces.

A hanging piece 1*a* is integrally formed on the underside of the front of the lid 1, and a tab 20 is formed on the end of the hanging piece 1*a*, which protrudes forwards and detachably engages the hook piece 15 of the slide piece 6. The tab 20 and the hook piece 15 form a hook 8 for detachably attaching the lid 1 to the slide piece 6. When the slide piece 6 is moved forwards in the case body 3, the hook 8 is released, and by moving the slide piece 6 backwards in the case body 3, the hook 8 is put in an engaging state. A through hole 21 through which the hanging piece 1*a* is inserted is formed through the canopy 10*a* of the inner plate 10.

Figure 6:
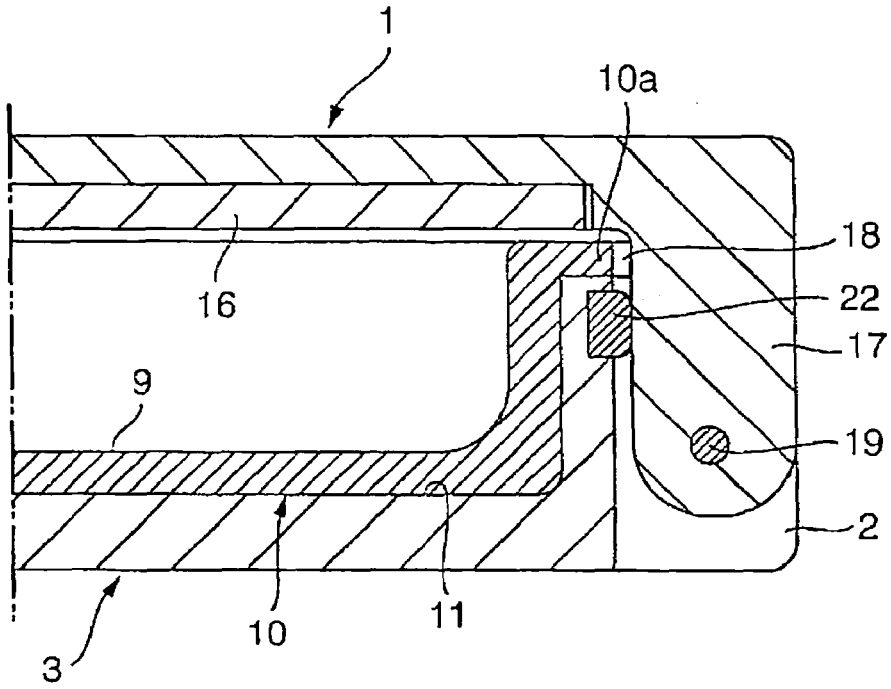
FIG. 6 is an enlarged side sectional view of a main part of the vanity case of FIG. 1.

Moreover, as shown in FIG. 6, there is provided an elastic body 22 such as a rubber as a biasing member between the back wall of the case body 3 back section and the hinge protrusions 17 of the lid 1. The elastic body 22 is provided in the back wall so as to protrude to the hinge protrusion 17, and when the lid 1 is closed, elastically contacts the hinge protrusion 17, thereby biasing the lid 1 toward opening against the hinge protrusion 17.

The action of the vanity case according to the present embodiment will be described. When assembling, the elastic arms 7 of the slide piece 6 are fitted in the transverse groove 14*b* of the groove 14 of the case body 3, and the rest of the slide piece 6 is placed in the longitudinal groove 14*a*. When the slide piece 6 is placed in the groove 14, the push portion 6*a* protrudes to the rear of the case body 3 through the opening 5. Then, the inner plate 10 is mounted on the case body 3. When the inner plate 10 is mounted, the rear end wall 4 is covered by the canopy 10*a* and cannot be seen from above. When the inner plate 10 is mounted, the upright wall 6*b* of the slide piece 6 and the hook piece 15 are located in the space "S" between the inner plate 10 and the case body 3. Then, by coupling the hinge 2 and the hinge protrusion 17 with the hinge pin 19, the lid 1 is rotatably attached to the case body 3. The assembly may be carried out in a way that first the lid 1 is attached to the case body 3.

In use of the vanity case, while the opened lid 1 is being closed, the hanging piece 1*a* of the lid 1 goes through the through hole 21 formed in the canopy 10*a* of the inner plate 10 and gets under the canopy 10*a*. The tab 20 of the hanging piece 1*a*, which is under the canopy 10*a*, contacts and pushes the hook piece 15 toward the front of the case body 3. By pushing the hook piece 15, the slide piece 6 is moved forwards in the case body 3 with opposing the spring back force of the elastic arms 7, and thus, the tab 20 gets under the hook piece 15 so that the hook 8 is in an engaging state, and the case body 3 is kept closed by the lid 1.

On the other hand, in order to open the lid 1, the rear end wall 4 of the case body 3 is pushed with a finger, which wall covers the opening 5 in the case body 3 back section and the push portion 6*a* of the slide piece 6 protruding through the opening 5. When pushing the elastic strip 4*b* of the rear end wall 4 toward the front of the case body 3, the push portion 6*a* of the slide piece 6 is pushed inwards of the case body 3. By this pushing in, the slide piece 6 is slid forwards in the case body 3 with opposing the spring back force of the elastic arms 7. By the slide piece 6 sliding forwards in the case body 3, the hook piece 15 of the hook 8 moves away from the tab 20. By the tab 20 moving away from the hook piece 15, the elastic body 22 biasing the lid 1 toward opening lifts the lid 1 up so as to be away from the case body 3.

Once the lid 1 is lifted up, the hook piece 15 no longer engages the tab 20, and the lid 1 can be opened smoothly. After the lid 1 is lifted up by the elastic body 22, by moving the finger away from the rear end wall 4, the slide piece 6 is slid by the elastic arms 7 backwards in the case body 3, and the push portion 6*a* protrudes to the rear end wall 4 through the opening 5, and the slide piece 6 waits for the lid 1 to be closed again.

In the vanity case according to the present embodiment, the rear end wall 4 conceals the opening 5 in the case body 3 back section and the push portion 6*a* of the slide piece 6. Hence, the appearance of the vanity case as seen from behind is improved. Further, because the opening 5 is concealed by the rear end wall 4 to a certain extent, dust or the like is correspondingly prevented from intruding. Yet further, because the push portion 6*a* and thus the slide piece 6 is slid and moved by operating the rear end wall 4, the size of the push portion 6*a* can be set small. Accordingly, the opening 5 can be made narrower so as to prevent effectively the intrusion of dust or the like into the case body 3. Even if the opening 5 is made narrower and the size of the push portion 6*a* is made smaller as such, the slide piece 6 can be made to act appropriately when pushing the rear end wall 4 adjacent to the hinges 2 which extends wide in the rear face of the case body 3. Therefore, good operability can be secured without making the opening 5 and the push portion 6*a* larger.

Moreover, since the elastic body 22 biasing the lid 1 toward opening is provided between the case body 3 and the lid 1, after pushing the slide piece 6 and releasing the engagement of the hook 8, when the finger is moved off the rear end wall 4, the hook 8 will not get in an engagement state again, and thus the lid 1 can be smoothly opened.

Figure 7:
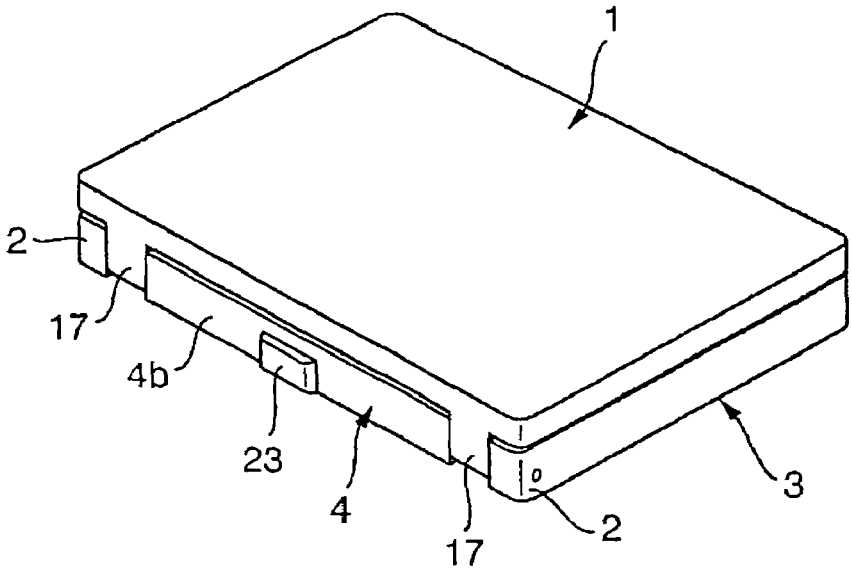
FIG. 7 is a perspective view of a variant of the vanity case according to the present invention as seen from above behind.

FIG. 7 shows a variant of the above embodiment. In the variant, a raised portion 23 slightly protruding backwards of the case body 3 is formed on the rear end wall 4. This raised portion 23 functions as a mark indicating an operation position. This means allows a user to recognize that an open/close operation portion for the lid 1 is in the case body 3 back section. Needless to say, this variant also produces the same effect as the above embodiment.

What is claimed is:

1. A vanity case which comprises a case body having a cavity, a lid that is coupled to a back section of the case body in an openable/closable manner, an inner plate that is received in an exchangeable manner in the cavity of the case body, and a slide piece that is housed in between the case body and the inner plate so as to be movable forwards and backwards, wherein the lid has an engaging claw piece formed hanging down on a front of its underside; the slide piece has an engaging arm protruding above that can engage with the engaging claw piece and is always biased elastically backwards; and the lid is always biased elastically toward opening of the case body, and wherein when the lid is dosed against the case body, the engaging claw piece of the lid engages with the engaging arm of the slide piece and thus the lid is in a closed position; when the slide piece is moved forwards, the engagement between the engaging arm of the slide piece and the engaging claw piece of the lid is released, thus opening the lid, characterized in that a rear end wall in a center of a rear of the case body is formed to be elastically deformable toward the front and two sides of the rear end wall are coupled to the case body so as not to move relative to the case body when the rear end wall is elastically deformed, and a rear end of the slide piece is placed opposite an inside surface of the rear end wall, whereby the elastic deformation of the rear end wall causes the rear end wall to engage and push on the slide piece to move the slide piece forward and release the engagement between the engaging arm of the slide piece and the engaging claw piece of the lid.

2. The vanity case according to claim 1, wherein a pair of recesses are formed on left and right sides of the rear end wall of the case body; left and right hinge protrusions protrude downwards from a rear end of the lid; the hinge protrusions are received in the pair of recesses so as to be hinge-coupled to the case body; and in the state where the lid is closed against the case body, rear faces of the hinge protrusions and the rear end wall of the case body are substantially on a same vertical plane.

3. The vanity case according to claim 2, wherein the cavity of the case body is surrounded by a front wall, side walls, and a back wall divided at its center into two separate parts, and the rear end wall is formed separately from and behind the back wall with arms between the walls.

4. The vanity case according to claim 1 or 2, wherein an elastic member is provided in between the case body and the lid to always bias the lid toward opening.

5. The vanity case of claim 1, wherein left and right sides of the rear end wall are coupled to the case body so as not to move relative to the case body when the rear end wall is elastically deformed.

6. The vanity case of claim 5, wherein upper and lower sides of the rear end wall are spaced apart from the case body and move relative to the case body when the rear end wall is elastically deformed.

7. The vanity case of claim 5, wherein at least one of upper and lower sides of the rear end wall move relative to the case body when the rear end wall is elastically deformed.

8. The vanity case of claim 3, wherein the arms couple left and right sides of the rear end wall to the case body.

9. The vanity case of claim 8, wherein the arms maintain the rear end wall in a spaced apart relation from the back wall of the case defining a portion of the cavity.

10. The vanity case of claim 2, wherein the case body includes left and right hinge portions that extend rearwardly from the case body, the pair of recesses are formed between the left and right sides of the rear end wall and the left and right hinge portions, and wherein rear faces of the hinge portions, the hinge protrusions, and the rear end wall are substantially on the same vertical plane.

11. The vanity case of claim 10, wherein the inner plate includes a rear flange that extends over a space between the rear end wall and a back wall of the case body that defines a portion of the cavity and extends over the hinge portions and the rear flange includes a pair of notches aligned with the pair of recesses.

12. The vanity case of claim 1, wherein the inner plate includes a rear flange that extends over a gap between the rear end wall and a back wall of the case body that defines a portion of the cavity.

13. The vanity case of claim 1, wherein the rear end wall is spaced rearwardly from a back wall of the case body that defines a portion of the cavity with a gap therebetween and the rear end of the slide piece is always biased to be in the gap.

* * * * *